US005835834A

United States Patent [19]

Asada

[11] Patent Number: 5,835,834

[45] Date of Patent: Nov. 10, 1998

[54] FUSER FOR FIXING TONER ON RECORDING PAPER WITH HEAT AND PRESSURE

[75] Inventor: Hidekazu Asada, Tokyo, Japan

[73] Assignee: NEC Corporation, Tokyo, Japan

[21] Appl. No.: 602,031

[22] Filed: Feb. 15, 1996

[30] Foreign Application Priority Data

Feb. 15, 1995 [JP] Japan ..... 7-026550

[51] Int. Cl.[6] ..... G03G 15/20

[52] U.S. Cl. ..... 399/328; 399/330; 399/331

[58] Field of Search ..... 355/285, 289, 355/290, 295, 279; 219/216; 399/328, 320, 322, 330, 331, 335, 339; 430/124, 126

[56] References Cited

U.S. PATENT DOCUMENTS

| | | | |
|---|---|---|---|
| 3,313,913 | 4/1967 | Limberger | 219/216 |
| 4,163,892 | 8/1979 | Komatsu et al. | 219/216 |
| 4,455,079 | 6/1984 | Miwa et al. | 355/295 X |
| 4,542,978 | 9/1985 | Tarumi et al. | 355/279 |
| 4,714,427 | 12/1987 | Tsuruoka et al. | 219/216 X |
| 5,057,875 | 10/1991 | Itoh | 355/290 X |
| 5,070,373 | 12/1991 | Fukano et al. | 355/290 |
| 5,245,393 | 9/1993 | Storlie et al. | 355/290 |
| 5,436,712 | 7/1995 | Wayman et al. | 355/290 |
| 5,463,444 | 10/1995 | Watanabe et al. | 219/216 X |
| 5,483,331 | 1/1996 | Wayman et al. | 355/285 |

*Primary Examiner*—Matthew S. Smith
*Attorney, Agent, or Firm*—Sughrue, Mion, Zinn, Macpeak & Seas, PLLC

[57] ABSTRACT

A toner image part of a paper is transferred to a contact area (12) of the main roller (3) and heat roller (6) and the toner (T) is heated by the heat roller (6) and is then fused sufficiently. In this case, the toner receives a small pressure from the heat roller and is then pressed toward the paper (P). The paper is taken up, while the toner is fused, along the paper guide by the contact area (14) between the main roller (3) and pressure roller (8). In this case, the toner is pressed on the paper with a large force generated between both rollers and also generates heat, thereby stably fixing the toner on the paper.

4 Claims, 2 Drawing Sheets

FUSER FOR FIXING TONER ON RECORDING PAPER WITH HEAT AND PRESSURE

BACKGROUND OF THE INVENTION

1. Field of the Invention

The present invention relates to a fuser comprised in an electrophotographic printer and more specifically to a fuser or fixing toner used in electrophotographic printer on a recording paper with heat and pressure.

2. Description of the Related Art

An existing electrophotographic fuser comprises, as shown in FIG. 1, a heat roller 55 having a heat source 55*a* at the inside thereof and a pressure roller 58 provided in contact with the heating roller 55 via a paper transfer path.

In more detail, both the heat roller 55 and pressure roller 58 are formed in the cylindrical shape and is supported, by a bearing (not illustrated) of the electrophotographic fuser 51, rotatable by means of parallel rotating shafts (not illustrated). Both the rollers 55, 58 are respectively placed in contact with each other at the external circumferential surfaces thereof, with the contact area forming the recording paper transfer path.

The heat roller 55 is rotated by a drive mechanism (not illustrated) fixed at one end thereof to exhaust a paper P on the paper transfer path formed in combination with the pressure roller 58 to external side of the electrophotographic fuser 51. The heat roller 55 and pressure roller 58 are respectively given the sufficient length to sufficiently hold the entire part of the width of the printing sheet P. Moreover, the heat source 55*a* heats the heat roller 55 for the entire part in the longitudinal direction along the center axis thereof. Moreover, the pressure roller 58 is covered with a silicon rubber material.

Rotation of the pressure roller 58 and heat roller 55 cause transferring the paper P. Upon transfer of the paper, a toner image T previously formed on the paper P by means of a development mechanism (not illustrated) is fused and deposited on the paper P with heat by means of the heat roller and pressure by means of the pressure roller to fix an image.

However, the related art described above has following disadvantages.

Namely, since the fuser in the related art almost simultaneously gives heat and pressure to the toner on the paper with the heat roller and pressure roller, an event that the fused toner blurs to a certain degree at the surface of paper is generated, resulting in a drawback that distinctness of image is lost. This phenomenon has been generated conspicuously in a color electrophotographic printer, as a problem to be solved.

SUMMARY OF THE INVENTION

It is therefore an object of the present invention to provide an electrophotographic fuser which can obtain more distinctive image, particularly to fix the toner on a paper P as the printing medium, by improving disadvantages of the related art explained previously.

According to the present invention, a fuser is provided by a main roller, a heat roller which contacts to the main roller via a paper tranfer path, and a presure roller which is located at the downstream side of the heat roller and contacts to the main roller.

When an electrophotographic printer operates the printing, a toner image is formed on the paper with an image forming means. This paper is then transferred on the paper transfer path located at the contact area of the main roller and heat roller.

A toner image on the paper is sufficiently fused when it is heated by the heat roller. In this case, the toner receives a small pressure from the heat roller and is pressed thereby to the paper.

While the toner is fused, the paper is taken into the contact area between the main roller and pressure roller running along the paper guide. Under this condition, the toner is pressed toward the paper with a comparatively large contact pressure occurring between both rollers, simultaneously releasing heat and thereby the toner is stably fused and fixed on the paper surface.

DETAILED DESCRIPTION OF THE PREFERRED EMBODIMENT

Figure 2:
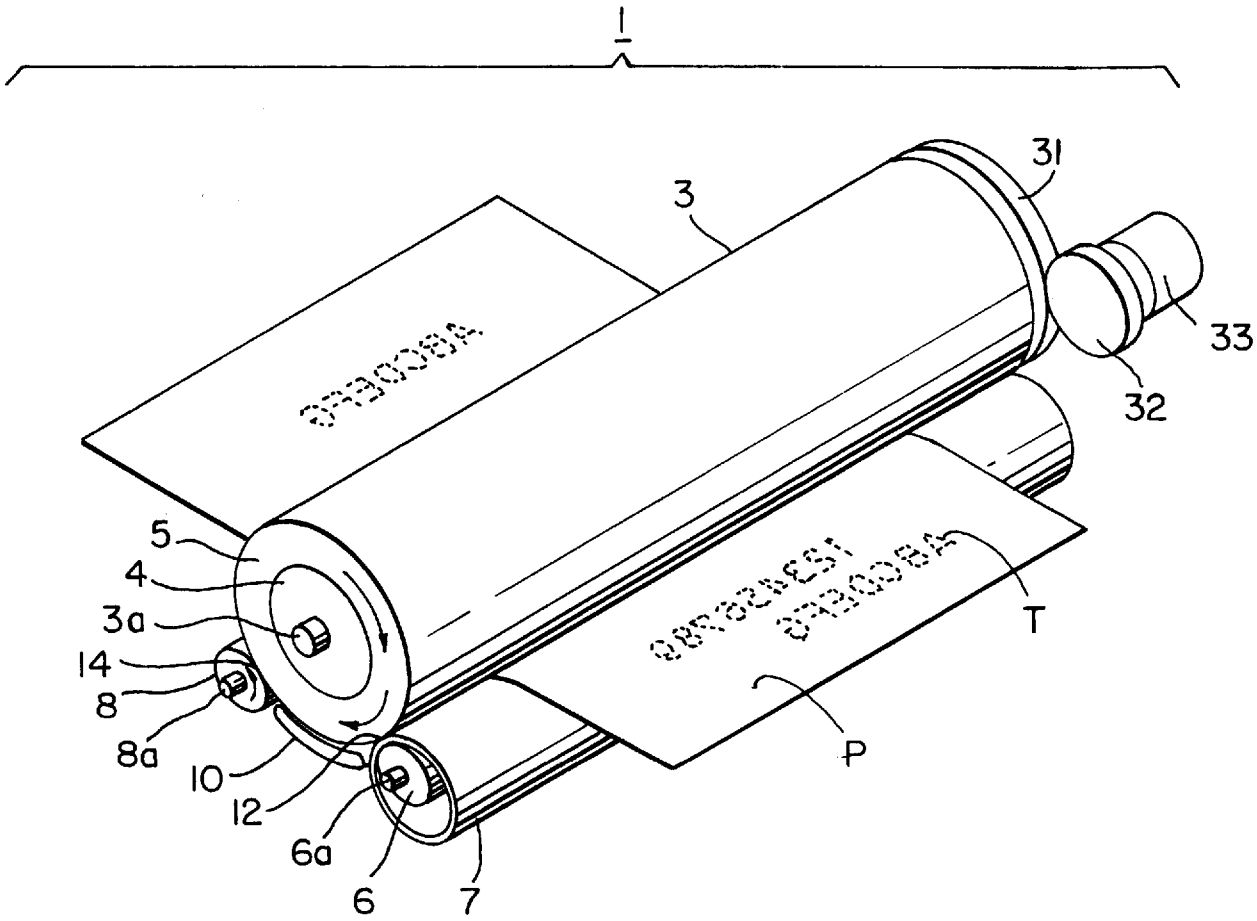
FIG. 2 is a perspective view illustrating a preferred embodiment of the present invention.

In FIG. 2, a fuser 1 of electrophotographic printer comprises a cylindrical main roller 3, a heat roller 6 which is in contact with the main roller 3 via a paper transfer path and a pressure roller 8 which is also in contact with the main roller 3 at the down-stream side of the heat roller 6 via the paper transfer path. Moreover, a cylindrical metal member 7 consisting of aluminum material is arranged between the heat roller 6 and main roller 3 and, in addition, a paper guide 10 for guiding transfer of the paper P is also provided between the heat roller 6 and pressure roller 8, near the external circumferential surface of the main roller 3.

The main roller 3 is composed of a cylindrical metal member 4 and silicon rubber 5 covering the circumference thereof. Moreover, the main roller 3 is formed in the length sufficient for assuring sufficient contact with the entire part of width of the paper P. The silicon rubber 5 energizes, with a constant pressing force, the entire part of the paper P transferred from a toner image forming unit of the electrophotographic printer.

In parallel to the center axis in the longitudinal direction of the main roller 3, a main roller rotating shaft 3*a* is formed in a projected manner from both end portions thereof. This rotating shaft 3*a* is formed of a metal shaft and is supported rotatably with a bearing portion (not illustrated) within the fuser 1. One end of the main roller 3 in the longitudinal direction thereof is engaged with the drive mechanism for rotating the main roller 3. This drive mechanism is composed of a drive gear 31 fixed at one end of the rotating shaft 3*a* of the main roller and a drive motor 33 provided with a gear 32 engaging with the drive gear 31. Responding to a fixing operation start signal of the controller (not illustrated), a current is supplied to the drive motor 33, causing the main roller 3 to be driven to start rotation.

The heat roller 6 is composed of a cylindrical halogen lamp in such a length as almost equal to the main roller 3. The halogen lamp is provided with a power supply mechanism (not illustrated), connected with the external power source, to supply the power for generating heat. Here, when the fixing operation is not performed, electrical power which is smaller than that required for the fixing operation is supplied to the halogen lamp for the power saving purpose.

The heat roller 6 is provided with the heat roller rotating shafts 6*a* projected from both ends in parallel with the center axis in the longitudinal direction thereof. The heat roller rotating shaft 6*a* is composed of a metal shaft and is supported, by the bearing portion (not illustrated) within the fuser 1, freely rotatable in parallel with the main roller rotating shaft 3*a*.

The heat roller 6 is arranged near the main roller 3 and is in contact with the main roller 3 via the cylindrical metal member 7 explained later. Therefore, the heat roller 6 is rotated, following rotation of the main roller 3. Thereby, the paper P fed along the paper transfer path not illustrated is taken up by the contact area 12 of the heat roller. The cylindrical metal 7 is provided around the heat roller 6 and is composed of cylindrical aluminum having the inner diameter larger than the outer diameter of the heat roller 6.

The center axes in the longitudinal directions of the cylindrical metal 7 and heat roller 6 are provided in parallel with each other, the heat roller 6 is inserted into the cylindrical meatal 7, and a part of the cylindrical metal 7 is in contact with the main roller 3.

The external surface of the cylindrical metal 7 is provided with the coating of fluorine, so that the toner T is not fused at the surface of the cylindrical metal 7 when the toner T on the paper P is heated. The coating of fluorine is performed by uniformly coating powder of the fluoric material or dispersing solution via a binder (bonding agent) and thereafter by baking such coating at a high temperature to fuse the fluoric material at the surface.

The pressure roller 8 has the length almost equal to the main roller 3 and takes up the paper transferred therebetween to be in contact with the entire part of the width of paper P. The pressure roller 8 is also provided with the coating of fluorine, as in the case of the cylindrical metal 7 as explained previously.

The pressure roller 8 is provided with the pressure roller rotating shafts projected from both ends in parallel with the center axis of the longitudinal direction thereof. The pressure roller rotating shaft 8*a* is formed of a metal shaft which is supported, with the bearing portion (not illustrated) within the fuser 1, rotatable in parallel with the main roller rotating shaft 3*a*.

The pressure roller 8 is provided in contact with the external circumference of the main roller 3. In more detail, it is provided at the position corresponding to the downstream side of the paper transfer path, viewed from the heat roller 6, at the external circumference of the main roller 3. In addition, the pressure roller 8 and main roller 3 are supported by the fuser 1 in such a positional relationship as generating a predetermined contact pressure in order to sufficiently fix the fused toner T with a pressure. Therefore, the pressure roller 8 rotates following the main roller 3 when it starts to rotate. Thereby, the paper P is taken up by the contact area 14 of the pressure roller and this pressure roller contact area 14 is formed as the paper transfer path.

Moreover, a paper guide 10 for guiding transfer of the paper P is provided, near the external circumference of the main roller 3, between the heat roller 6 and pressure roller 8. In more detail, the paper guide 10 is formed in almost the rectangular shape in the length almost equal to the main roller 3 but is shorter than the distance between the heat roller 6 and pressure roller 8. The paper guide 10 is also curved with the radius of curvature which is almost equal to the external circumference of the main roller 3.

The paper guide 10 is fixed in the fuser 1 in such a location as generating a small clearance against the main roller 3, allowing the paper P taken up and transferred by the heat roller contact area 12, to enter the clearance. In addition, the paper P exhausted from the clearance is taken up by the pressure roller contact area 14 by means of the paper guide 10.

Next, operation and function of the fuser 1 will be explained with reference to FIG. 2.

Figure 1:
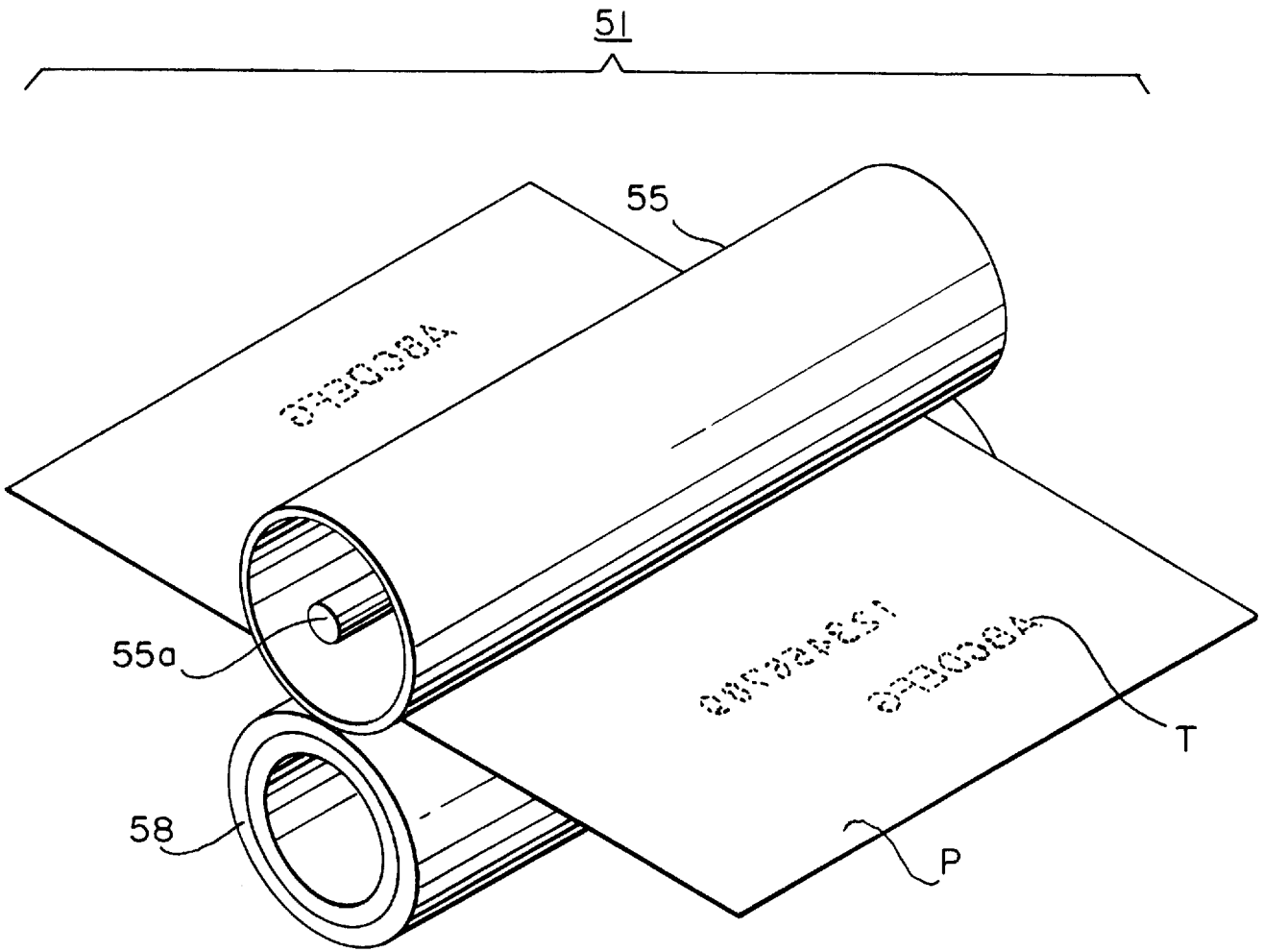
FIG. 1 PRIOR ART
FIG. 1 is a perspective view illustrating a fuser of the related art.

The paper P on which a toner image T is formed on the surface (at the lower surface of the paper P in FIG. 1) by the toner image forming unit is transferred to the paper transfer path formed at the heat roller contact area 12 by the transfer mechanism not illustrated. In this case, the main roller 3 is driven and rotated by the motor 33 with the fixing start signal, causing the heat roller 6 and pressure roller 8 to rotate. Thereby, the paper P carried into the paper transfer path is transferred by the fuser 1 for the fixing of the toner image T.

The fixing process explained above will be further explained in more detail. Through the toner image forming process, an image of unfixed toner T is formed at the surface of the paper P.

The paper P is carried along the paper transfer path passing through the heat roller contact area 12. In this timing, the heat roller 6 generates predetermined amount of heat due to heat generation by the halogen lamp 6 and this heat is transmitted to the toner T on the paper P held against the main roller 3 via the cylindrical metal member 7 to fuse the toner T. Since a small contact pressure is generated via the cylindrical metal member 7 between the heat roller 6 and main roller 3, the fused toner T is gradually fixed on the paper P. That is, fixing is mainly conducted by the heat at the heat roller contact area 12.

Here, amount of heat generated by the halogen lamp 6 is set considering the time ensuring the period for contact between the toner T and cylindrical metal member 7 and the amount of heat and temperature required for fixing of the toner T. Moreover, since the period for contact with toner T can be increased by setting a larger diameter of the cylindrical metal member 7, transfer speed can be raised and quick heating can also be realized.

Next, since the paper P having passed the heat roller contact area 12 is transferred to the clearance between the paper guide 10 and main roller 3, the paper P is separated from the cylindrical metal member 7 and is then transferred in the direction of the pressure roller contact area 14. Separation between the paper P and cylindrical metal member 7 can be done smoothly without resulting in development by fused deposition since the surface of the cylindrical metal member 7 is coated with fluorine.

The paper P guided by the paper guide 10 is taken up by the pressure roller contact area 14. A contact pressure which is sufficient for fixing a toner T on the paper P is energized between the pressure roller 8 and main roller 3 and the toner T which is already fused can be fixed to obtain distinctive images. Moreover, since the surface of pressure roller 8 is fluorine-coated, the paper P can easily be separated without fusing of the toner T.

The paper P completely passes through the pressure roller contact area 14 and is then exhausted to the outside from the electrophotographic fuser 1, thereby terminating the process of the fixing operation.

As explained above, since the fuser 1 of FIG. 1 separately arranges the heating means and pressing means, a more distinctive image can be formed in comparison with the existing fuser which performs the fixing operation simultaneously with heat and pressure.

Moreover, since the heat roller and pressure roller are respectively provided for only one main roller, this constitution is rather simplified in comparison with that providing two pairs of rollers (four rollers), realizing reduction of cost and space.

Furthermore, the heat roller is not required to generate a large contact pressure against the main roller, the strength required for the heat roller itself can be lowered. Thereby, excellent effect can be realized when the halogen lamp is used as the heat roller.

Moreover, effective heating operation can be assured because the cylindrical member is heated by heating the toner via the cylindrical metal member. In addition, the more excellent effect that the toner can be heated sufficiently even under the quick transfer speed can also be obtained by adequately setting the diameter of the cylindrical metal member. Since aluminum having good heat conductivity is used for the cylindrical metal member, heat is uniformly applied to the toner to form more distinctive image.

What is claimed is:

1. A fuser for fixing an unfixed toner image formed on a paper, comprising:

a cylindrical main roller;

a heat roller which is in contact with said main roller through a paper transfer path by a small contact pressure so that a fixing is mainly conducted by heat; and a pressure roller which is in contact with said main roller at the down-stream side of said heat roller through said paper transfer path by a contact pressure which is sufficient for fixing the toner image heated by said heat roller on the paper completely.

2. The fuser according to claim 1, wherein said heat roller has a cylindrical halogen lamp.

3. The fuser according to claim 1, wherein said heat roller is placed in contact with said main roller through a cylindrical metal member.

4. The fuser according to claim 3, wherein said cylindrical metal member is formed of aluminum.

* * * * *